United States Patent [19]

Marder et al.

[11] Patent Number: 4,596,614

[45] Date of Patent: Jun. 24, 1986

[54] GRAIN ORIENTED ELECTRICAL STEEL AND METHOD

[75] Inventors: Arnold R. Marder; Philip M. Giles, both of Bethlehem, Pa.

[73] Assignee: Bethlehem Steel Corporation, Bethlehem, Pa.

[21] Appl. No.: 667,923

[22] Filed: Nov. 2, 1984

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,632,456 | 1/1972 | Sakakura et al. | 148/112 |
| 3,636,579 | 1/1972 | Sakakura et al. | 148/111 |
| 3,841,924 | 10/1974 | Sakakura et al. | 148/111 |
| 3,853,641 | 12/1974 | Sakakura et al. | 148/111 |
| 4,046,602 | 9/1977 | Stanley | 148/111 |
| 4,302,257 | 11/1981 | Matsumoto et al. | 148/111 |

*Primary Examiner*—John P. Sheehan

*Attorney, Agent, or Firm*—William B. Noll

[57] ABSTRACT

The invention is directed to a low-silicon, grain oriented electrical steel exhibiting a Goss texture. Compositionally, such steel comprises, by wt. %:

C—0.02/0.07
Mn—<0.50
Si—0.5/2.0
S—<0.05
Al—0.01/0.5
N—0.005/0.03
Fe—balance,

The texture for such a steel, in the form of sheet or strip, is achieved by a processing sequence which includes among its other steps or features, the provision of a short time transcritical anneal prior to a final cold reduction of the sheet or strip.

7 Claims, 1 Drawing Figure

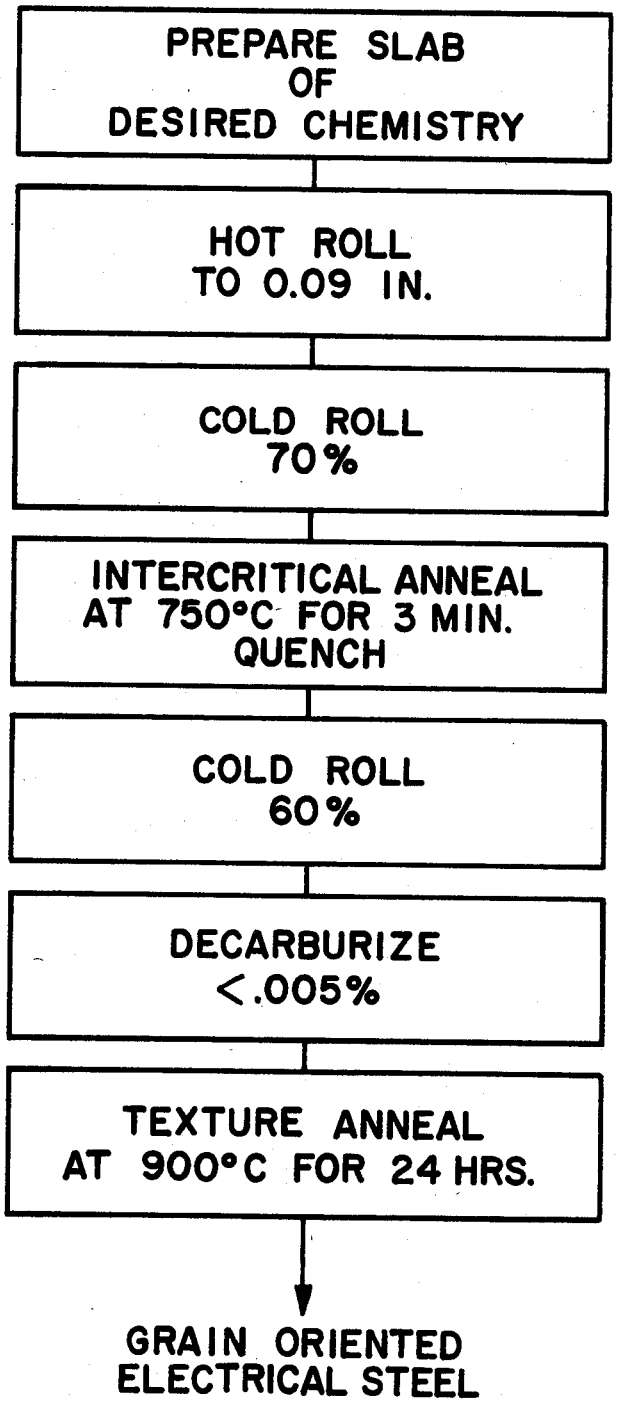
PREPARE SLAB
OF
DESIRED CHEMISTRY
HOT ROLL
TO 0.09 IN.
COLD ROLL
70%
INTERCRITICAL ANNEAL
AT 750°C FOR 3 MIN.
QUENCH
COLD ROLL
60%
DECARBURIZE
<.005%
TEXTURE ANNEAL
AT 900°C FOR 24 HRS.
GRAIN ORIENTED
ELECTRICAL STEEL

GRAIN ORIENTED ELECTRICAL STEEL AND METHOD

BACKGROUND OF THE INVENTION

This invention is directed to a process for the production of a low-silicon, grain oriented electrical steel, such as sheet and strip, and to the product thereof. More particularly, the steel of this invention is characterized by a Goss texture, a crystalline orientation as defined by Miller indices of (110) [001].

Oriented electrical steels have been used for a number of years in the manufacture of transformers and the like. Such steels are characterized by such magnetic properties as high permeability and low core loss. By this combination it is possible to minimize energy losses in the transformer. Typically such prior art oriented electrical steels were produced from steels containing at least 3.0%, by wt., silicon, and one or more grain growth inhibitors, such as manganese sulfide and aluminum nitride. The processing thereof had to be carefully controlled, and was characterized by one or more high temperature anneals.

While high silicon steels remain as a major product in the field of electrical steels, there have been recent efforts to reduce the amount of silicon needed, yet still produce a grain oriented sheet product suitable as a transformer steel.

U.S. Pat. No. 4,251,296 to Thornburg et al represents one such effort to produce the (110) [001] texture in a low alloy steel. Among other steps, critical features are the control of the sulfur, carbon, manganese, and oxygen contents, and an anneal of at least 1 hour between 750° and the $AC_1$ temperature prior to the final cold reduction.

In U.S. Pat. No. 3,636,579 to Sakakura et al there is disclosed a process for producing single-oriented electrical steel sheet in a steel containing up to 4%, by wt., silicon. The intermediate anneal, i.e. anneal prior to final cold reduction, is for an extended period, and the temperature is adjusted according to the silicon and carbon contents. Additionally, the annealed steel is quenched at a rate of 2° to 200° C. per sec. to at least 400° C. from the maximum annealing temperature.

Unexpectedly, among several features, by the present invention it was discovered that it was possible to design a processing sequence for the production of electrical steels which included a short time, transcritical anneal prior to the final cold reduction of the steel strip. Such feature, along with others of this invention, shall become apparent from the description which follows.

SUMMARY OF THE INVENTION

The present invention is directed to the production of a grain oriented electrical steel from a steel consisting essentially of, by wt. %:

C—0.02/0.07
Mn—<0.5
Si—0.5/2.0
S—<0.05
Al—0.01/0.5
N—0.005/0.03
Fe—balance, and processed by the following sequence:

(a) hot roll
(b) cold roll (optional)
(c) short time transcritical anneal and quench (d) cold roll
(e) decarburize, and
(f) texture anneal.

The steel's Goss texture, or crystalline orientation as defined by Miller indices of (110) [001], is achieved in part by balancing the chemistry to assure the presence of (1) at least 100 ppm of AlN prior to decarburization, and (2) a hard phase, such as martensite, cementite, or combination thereof, prior to the final cold reduction.

BRIEF DESCRIPTION OF THE DRAWINGS

The FIGURE is a flow diagram of a preferred process for practicing the invention.

DETAILED DESCRIPTION OF PREFERRED EMBODIMENT

The present invention is directed to a process for making low silicon, grain oriented electrical steel by the steps which include a transcritical anneal and controlled rate of cooling, prior to a final cold reduction, to help achieve a Goss texture. By transcritical anneal we mean to include temperatures within or below the intercritical range. Exemplary temperatures are presented in the description which follows. In any event, it was discovered that such step was critical to the production of the desired orientation after a final cold reduction, decarburization, and texture anneal. This will all become apparent in the description which follows.

While the invention relates to the production of an electrical steel whose composition falls within the broad limits, by wt. %:

C—0.02/0.07
Mn—<0.5
Si—0.5/2.0
S—<0.05
Al—0.01/0.5
N—0.005/0.03
Fe—balance, for convenience, the further description will be directed to the production of an exemplary 1% silicon steel by the preferred practice illustrated in the FIGURE.

To illustrate the invention, seven (7) different heats were melted according to the above limits. The chemistries thereof are listed in Table I.

TABLE I

| | CHEMISTRY | | | | | |
|---|---|---|---|---|---|---|
| Heat | C | Mn | S | Si | Al | N |
| A | 0.061 | 0.01 | 0.005 | 0.97 | 0.007 | 0.0016 |
| B | 0.060 | 0.01 | 0.005 | 0.98 | 0.016 | 0.0060 |
| C | 0.062 | 0.01 | 0.005 | 1.00 | 0.025 | 0.0120 |
| D | 0.059 | 0.01 | 0.005 | 0.98 | 0.036 | 0.0160 |
| E | 0.056 | 0.01 | 0.005 | 0.97 | 0.053 | 0.0200 |
| F | 0.013 | 0.015 | 0.025 | 0.97 | 0.021 | 0.0073 |
| G | 0.038 | 0.12 | 0.024 | 0.95 | 0.019 | 0.0064 |

P, Cu, V, Ti, O each 0.005 max.
Ni, Cr, Mo, each 0.02 max.

Heats A–E were vacuum melted and cast into ingots, whereas F and G were conventionally melted and cast to insure the presence of MnS, so as to determine its effect on the steels of this invention.

The ingots (Heats A–E) were slowly heated to 2300° to 2350° F. and soaked for about two hours prior to hot rolling to 0.70 to 0.75 inch in the temperature range 1700° to 2000° F. Ingots from Heats F and G were comparably processed to a hot rolled thickness of 0.50 inch.

Samples of the seven heats were prepared for simulated hot strip mill rolling by machining samples (2.5" by full plate width) from the hot-rolled plates.

These samples were then heated at 2300° F. for two hours under a protective argon atmosphere and processed using the following parameters:

Rolling temperature and estimated percent reductions—2000° F./35%, 1850° F./60%, and 1600° F./50%; quench (cooling rates approximately 40° F. per second) to 1250° F. to simulate a coiling temperature of 1250° F.; control cool at 50° F. per hour to room temperature.

The resulting samples, typically 0.1×7.5×18", were then cold rolled to approximately 0.062" thickness.

While the preceding steps represent conventional practice, that which follows is a clear departure therefrom. For example, it was discovered that the presence of a hard phase, such as martensite or cementite, or a combination thereof, had an effect on texture development and magnetic properties. To determine such effect, two different heat treating methods were utilized. The first was intended to produce a wide range of hard phase content at constant aluminum nitride content, and the second, to produce a constant hard phase content for samples having different aluminum nitride concentrations:

(1) Samples, approximately 0.052×2.5×6.0", were heated at temperatures ranging from 1350° to 1675° F. in a vertical tube furnace under a protective argon atmosphere for five minutes followed by quenching in an agitated 5% sodium hydroxide solution.

(2) Samples, approximately 0.052×6.5×7.5", were heated at 1495° to 1510° F. in neutral salt for 90 seconds followed by quenching in an agitated 5% sodium hydroxide solution.

The samples were next subjected to final cold rolling of about 80% to a nominal thickness of 0.011 inch. While such cold rolling may be as little as 40%, it is preferred to have a cold rolling of at least 55%. Thereafter, the samples were decarburized to a carbon content of less than about 0.004%, by wt. by one of the following two methods:

(1) Heated in a vertical tube furnace at 1400° F. in 18% hydrogen-nitrogen having a dew point of 55° F. for 16 minutes and cooled in an argon atmosphere.

(2) Heated at 1500° F. in the hot zone of a horizontal tube furnace and retained there for 35 minutes at temperatures ranging between 1400° and 1500° F. in an atmosphere of 18% hydrogen-nitrogen having a dew point of 72° F. Samples were cooled in a dry 18% $H_2$—$N_2$ atmosphere by moving to a lower temperature section of the furnace.

The final processing step is the texture anneal. As is well known, the purpose of such anneal is to heat the steel to high enough temperatures for a sufficiently long period of time to cause the previously pinned grain boundaries to move, resulting in a coarser and oriented grain structure. Consequently, the samples were heated to temperatures between 1250° F. to 1750° F. While a preferred temperature is about 1650° F., the broad annealing range was selected to determine the effect of aluminum nitride concentration and martensite volume fraction on the temperature at which secondary recrystallization is initiated. Additionally, such range was selected so as to pinpoint the $AC_1$ critical temperature for those low silicon steels of this invention. For example, in 1% silicon steels, the maximum annealing temperature must be below the $AC_1$, otherwise there will occur a transformation to austenite. This will ruin the texture. In any case, the samples were heated in an atmosphere of dry 18% hydrogen-nitrogen at a rate of 100° F. per hour, held for 25 hours at temperature, and furnace cooled.

The foregoing represents an exemplary procedure for producing grain oriented electrical steel according to this invention. When so processed, a typical steel will exhibit a 15 KGauss core loss of about 1.0 watts per pound, and an equivalent permeability to the higher, i.e. 3%, silicon steels.

Two important features of this unique processing sequence are the provision of the presence of AlN, which only need be present in a preferred amount of from 100 to 200 ppm. min., and the presence of a hard phase, such as martensite, cementite, or combination thereof. To help understand such features, we subjected a number of samples to variations in the thermal cycles. Table II lists such thermal cycles, and Table III quantifies the respective amounts of hard phase and precipitate present.

TABLE II

PROCESSING SUMMARY

| Heat Code | Intercritical Anneal (Atm/Time/Temp.) | Decarburizing (Temp/Time/Dew Pt.) | Texture Anneal Temperature |
|---|---|---|---|
| A-1 | Salt/90 s/1500° F. | 1400° F./16 m/55° F. | 1505° F. |
| B-1 | Salt/90 s/1500° F. | 1400° F./16 m/55° F. | 1530° F. |
| C-1 | Salt/90 s/1495° F. | 1400° F./16 m/55° F. | 1615° F. |
| D-1 | Salt/90 s/1500° F. | 1400° F./16 m/55° F. | 1615° F. |
| E-1 | Salt/90 s/1510° F. | 1400° F./16 m/55° F. | 1615° F. |
| A-2 | Salt/90 s/1505° F. | 1450° F./35 m/72° F. | 1650° F. |
| B-2 | Salt/90 s/1500° F. | 1450° F./35 m/72° F. | 1650° F. |
| C-2 | Salt/90 s/1500° F. | 1450° F./35 m/72° F. | 1650° F. |
| D-2 | Salt/90 s/1500° F. | 1450° F./35 m/72° F. | 1650° F. |
| E-2 | Salt/90 s/1505° F. | 1450° F./35 m/72° F. | 1650° F. |
| C-1350 | Argon/5 m/1350° F. | 1400° F./16 m/55° F. | 1615° F. |
| C-1450 | Argon/5 m/1450° F. | 1400° F./16 m/55° F. | 1615° F. |
| C-1525 | Argon/5 m/1525° F. | 1400° F./16 m/55° F. | 1580° F. |
| C-1625 | Argon/5 m/1625° F. | 1400° F./16 m/55° F. | 1615° F. |
| C-1675 | Argon/5 m/1675° F. | 1400° F./16 m/55° F. | 1685° F. |
| F | Salt/90 s/1500° F. | 1400° F./16 m/55° F. | 1685° F. |
| G | Salt/90 s/1500° F. | 1400° F./16 m/55° F. | 1640° F. |

TABLE III

| Heat Code | Martensite, % | Aluminum* Nitride, ppm | Nitrogen, **ppm |
|---|---|---|---|
| A-1 | 9.3 | 47 | 48 |
| B-1 | 6.3 | 180 | 110 |
| C-1 | 6.4 | 352 | 170 |
| D-1 | 6.6 | 467 | 250 |
| E-1 | 7.7 | 586 | 360 |
| A-2 | 6.6 | 47 | 40 |
| D-2 | 7.1 | 180 | 110 |
| C-2 | 5.8 | 352 | 160 |
| D-2 | 7.3 | 467 | 230 |
| E-2 | 4.6 | 586 | 340 |
| C-1350 | 0.9° | 352 | 180 |
| C-1450 | 7.7 | 352 | 170 |
| C-1525 | 11.4 | 352 | 180 |
| C-1625 | 17.8 | 352 | 170 |
| C-1675 | 19.7 | 352 | 160 |
| F | 0.2° | 214 | 140 |
| G | 7.5 | 188 | 130 |

*during decarburization
**after texture anneal
°cementite, calculated from carbon concentration The results of the processing summary set forth in Table II are listed below as Table IV.

TABLE IV

| Heat Code | Induction (KGauss) at 1 Oe | Induction (KGauss) at 10 Oe | Magnetic Properties of 0.010" Sheet at 15 KGauss: Core Loss, wpp | Magnetic Properties of 0.010" Sheet at 15 KGauss: Permeability KG/Oe |
|---|---|---|---|---|
| A-1 | 15.1 | 19.0 | 0.99 | 15.5 |
| B-1 | 15.2 | 19.1 | 1.00 | 15.5 |
| C-1 | 14.4 | 18.3 | 1.09 | 12.4 |
| D-1 | 14.5 | 18.5 | 1.10 | 12.9 |
| E-1 | 14.8 | 19.2 | 1.11 | 14.1 |
| A-2 | 13.6 | 17.1 | 1.15 | 10.0 |
| B-2 | 14.7 | 18.6 | 1.03 | 13.7 |
| C-2 | 14.1 | 17.5 | 1.10 | 11.4 |
| D-2 | 15.1 | 18.9 | 1.04 | 15.0 |
| E-2 | 14.9 | 18.9 | 1.11 | 14.1 |
| C-1350 | 15.6 | 19.5 | 0.99 | 16.3 |
| C-1450 | 14.7 | 18.4 | 1.05 | 13.7 |
| C-1525 | 14.9 | 18.5 | 1.03 | 14.3 |
| C-1625 | 14.9 | 18.7 | 1.03 | 14.6 |
| C-1675 | 15.1 | 19.0 | 1.02 | 14.9 |
| F | 11.7 | 16.9 | 1.78 | 6.7 |
| G | 14.9 | 18.5 | 1.06 | 14.6 |

It will be observed that Heat A had the lowest AlN content, yet was generally sufficient to inhibit grain growth which would adversely affect magnetic properties. However, isolated instances of undesirable grain growth were observed in this Heat. Therefore, to be safe, it is preferred to have a minimum of from 100 to 200 ppm.

An undesirable core loss was observed in Heat F at 1.78. The sample produced therefrom had the lowest vol. % of a hard phase, i.e. 0.2%. In contrast, the sample from Heat Code C-1350 had only a small quantity more, but yet its magnetic properties were among the best. Accordingly, it is estimated that the vol.% of a hard phase should be at least about 0.5%.

As a result of this invention, it is now possible to produce a low silicon, oriented electrical grade steel by a practice which avoids the high temperatures associated with the higher silicon containing grades.

We claim:

1. In a process for the production of grain oriented, electrical steels exhibiting a crystalline orientation as defined by Miller indices (110) [001], including the steps of initially reducing said steel to strip form, annealing and quenching, cold rolling, decarburizing and texture and quenching, cold rolling, decarburizing and therewith the steps of selecting a steel which comprises, by wt. %:

C—0.02/0.07
Mn—<0.5
Si—0.5/2.0
S—<0.05
Al—0.01/0.5
N—0.005/0.3
Fe—balance, and by a transcritical anneal and quench immediately prior to said final cold rolling, where said anneal is for a period of time less than about ten minutes so as to retain upon cooling at least about 0.5%, by volume, of a hard phase selected from the group consisting of martensite, cementite, or a combination thereof.

2. The process according to claim 1 characterized in that the final cold rolling is a least 40%.

3. The process according to claim 1 characterized in that the carbon is reduced during said decarburizing step to less than about 0.005%.

4. The process according to claim 1 characterized in that said transcritical anneal is conducted at a temperature between about 1200° to 1450° F. for a period of time less than about six minutes.

5. The process according to claim 4 characterized in that said texture anneal is conducted at a temperature between about 1450° and 1685° F.

6. The process according to claim 1 characterized in that AlN is present in a sufficient amount to act as a grain boundary pinning agent during said decarburization.

7. The process according to claim 6 characterized in that AlN is present in the amount of about 100 to 200 ppm.

* * * * *